United States Patent [19]

Schmidt

[11] 4,151,663

[45] May 1, 1979

[54] SNOW REMOVAL UNIT

[75] Inventor: Alfred Schmidt, St. Blasien, Fed. Rep. of Germany

[73] Assignee: Ing. Alfred Schmidt GmbH, Fed. Rep. of Germany

[21] Appl. No.: 905,447

[22] Filed: May 12, 1978

[30] Foreign Application Priority Data

May 12, 1977 [DE] Fed. Rep. of Germany ..... 2721411

[51] Int. Cl.[2] ..... E01H 5/00

[52] U.S. Cl. ..... 37/43 K

[58] Field of Search ..... 37/43 R, 43 K, 23, 26, 37/27

[56] References Cited

U.S. PATENT DOCUMENTS 1,671,358 5/1928 Fahrney ..... 37/23 X 3,618,748 3/1970 Burkett ..... 37/43 K

FOREIGN PATENT DOCUMENTS 309121 11/1955 Switzerland ..... 37/43 K

*Primary Examiner*—E. H. Eickholt

[57] ABSTRACT

A snow removal unit having a housing open at its front end in which a central fan blower is mounted. Mounted to the housing forwardly of and flanking the central fan are a pair of vertically rotating clearing screws. The clearing screws are mounted so as to be swingable relatively to the housing, about a vertical axis independently of each other. Each of the screws is also provided with a rear deflector plate which is also swingable about a vertical axis together with or independently of the associated clearing screw.

11 Claims, 3 Drawing Figures

SNOW REMOVAL UNIT

BACKGROUND OF THE INVENTION

The present invention relates to snow removal equipment and in particular to a snow blower for attachment to railed vehicles.

Snow blowers for railed vehicles are shown in Austrian patent publication AT-PS 164901. In this patent, a snow removal unit is disclosed comprising a central snow blower flanked by a pair of vertical clearing screws mounted on a housing which is adapted to be hitched to the front end of a railway vehicle. The back of each of the clearing screws is provided with a deflector plate adapted to force introduction of snow into the central fan.

When curved sections of railway right-of-way are to be cleared, a relatively large clearing width is necessary to avoid the penetration or contact of the outer edges of the curving vehicle with the snow bank formed on the inside of the curved section. On the other hand, tunnels are often too narrow for snow removal equipment of such width.

The present invention provides a snow removal unit adapted to clear railway rights-of-way which is particularly adapted to the clearing of both straight and curved sections as may be selectively necessary.

SUMMARY OF THE INVENTION

According to the present invention, a snow removal unit is provided having a housing open at its front end in which a central fan blower is mounted. Mounted to the housing forwardly of and flanking the central fan are a pair of vertically rotating clearing screws. The clearing screws are mounted so as to be swingable relatively to the housing, about a vertical axis independently of each other. Preferably, each of the screws is also provided with a rear deflector plate which is also swingable about a vertical axis together with or independently of the associated clearing screw.

The deflector plates are prefereably mounted and movable between at least two basic positions, the first being contiguous with the peripheral surface of the associated screw and the second being removed from the screw and spaced completely therefrom. Several intermediate positions may also be provided for the swing of the deflector.

Full details of the present invention are set forth in the following description of the preferred embodiment and in the accompanying drawings.

DESCRIPTION OF THE PREFERRED EMBODIMENT

Figure 1:
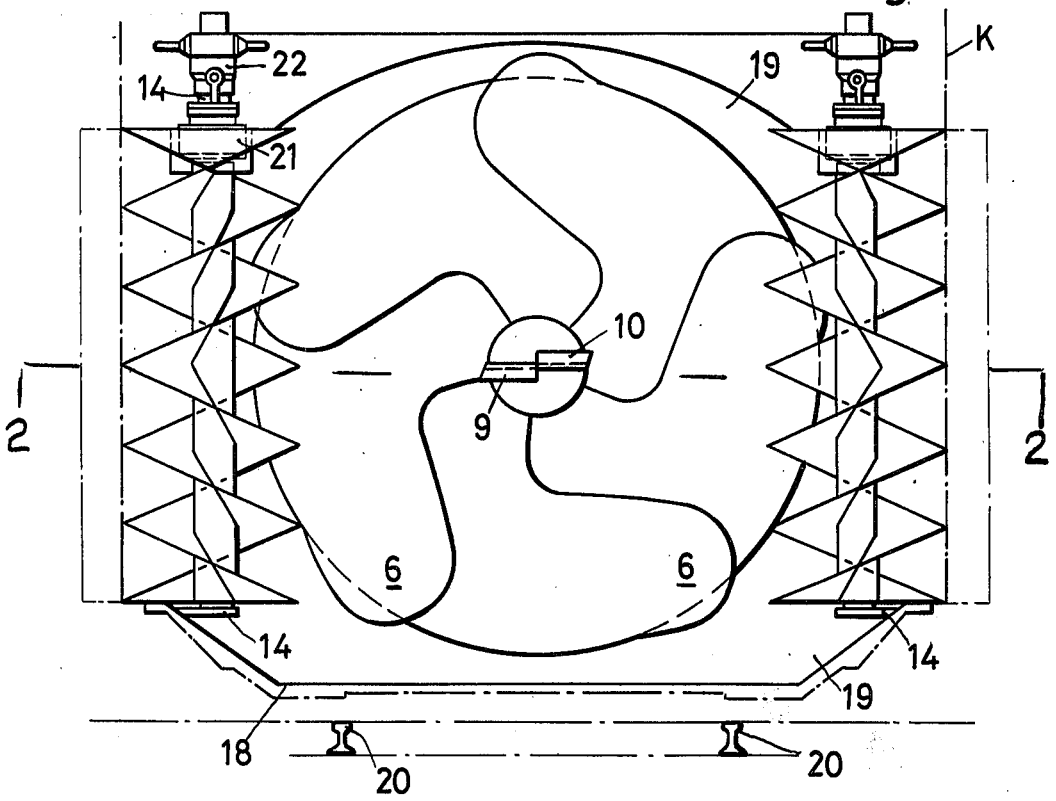
FIG. 1 is a front view of a snow removal unit formed in accordance with the present invention.
Figure 2:
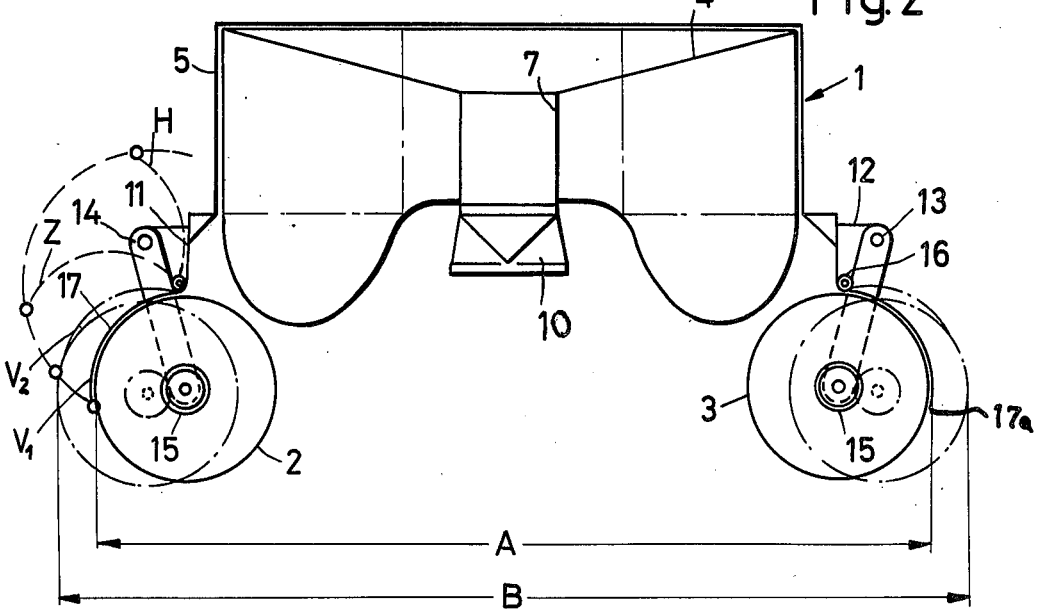
FIG. 2 is a view of the unit shown in FIG. 2, taken through the center thereof along lines 2—2.

As seen in FIGS. 1 and 2, the snow removal unit consists essentially of a central snow blower, generally depicted by the numeral 1 and a pair of lateral clearing screws 2 and 3 mounted forwardly and slightly to the side of the snow blower, so as to flank it. The blower 1 comprises a fan wheel 4 arranged within a covering housing 5. The housing 5 forms a conventional side and back hood open at its forward end and is provided with an ejection stack or chimney chute as well as usual means for attachment to the vehicle, such as the head car of a train. The fan has five curved blades secured at their root to a hub 7 rotatable about a fixed horizontal axis. The hub has at its forward end or clearing side, a precutter formed of two linear knives 9 and 10. The hub 7 houses the fan shaft which extends through the back wall of the housing and is connected to drive means such as a motor or a gear transmission connected to a motor as is well known. The fan and blades rotate in a vertical plane generally perpendicular to the horizontal axis of the hub.

The housing is formed on each of its lateral sides with a vertical forward extension 11 to the upper and lower ends of which are unitarily formed or integrally secured lateral projecting brackets 12. Each of the brackets 12 mounts a vertical pivot axle 13 on which one end of a straight lever arm 14 is journalled. Each clearing screw, comprising a helical screw member secured by their root to a central shaft is mounted between the free ends of opposed pairs of lever arms 14, the central axle passing through a journal upper and lower arms 14.

Pivotally secured to the forward edge of each of the housing extensions 11 is a hinge 16, such as a piano hinge, on which a pivoting deflector plate 17 is secured. The hinge 16 is adjacent the associate screw member and the deflecting plate is preferably sheet metal extending arcuately, conforming to the generatrix of the associated screw about the rear portion thereof so as to form a back wall. The arcuate extent of the deflector plate is such that its forward edge 17*a* lies to the front of the central axis defined by the shaft 15, by about 20 to 30 degrees of angle, when the deflector plate is contiguous to the associated screw. The deflector plate extends between the supporting lever arms 14 and preferably above and below the top and the top flights of the screw. Both the clearing screws 2 and 3 and the deflector plates 17 are swingable with respect to the housing, as well as with respect to each other about the axis formed by the pivot axles 13 and the hinges 16, respectively. The axis defined by the pivot axle 13 and the hinges 16 are each vertical and parallel to the axis of rotation of the associated screws.

As is seen in FIG. 2, the clearing screws 2 and 3 and the associated deflector plates 17 are swingable into several positions. For example, a first clearing position in which the screws 2 and 3 are separated by the distance indicated by the arrows A and a second clearing position indicated by dot-dash lines having the dimensional width indicated by the arrows B. In both these positions, the screw is sufficiently placed with respect to the central fan so that their rotation causes snow to the flanks of the vehicle to be introduced directly into the fan.

In addition, as is seen in FIG. 2, the deflector plates 17 can take various positions coupled with or independently of the associated clearing screws. For example, as is seen in the left side of FIG. 2, the deflector plate 17 has the normal infront position $V_1$ contiguous to the clearing screw when the screw is in its first work position indicated by the arrows A; a second pivoted front position $V_2$ when the work screw is pivoted into the second work position B; an intermediate position Z further to the rear of the clearing screw which is only slightly separated from the screw but which enlarges the clearing width by extending the deflector plate laterally from the screw, and; a rear disengaged position H in which the deflector plate extends so far to the rear of the screw that it is not only completely removed from the screw but it has no effect on the snow clearing operation at all.

The effect of selectively swinging the screws and the associated deflector plate is clearly illustrated in FIG. 1. In the dot-dash outline K indicated in FIG. 1, the proportional outer contour of a standard railway vehicle is shown. The vehicle includes the customary bottom knife 18 of which only the outer contour edge is seen. The bottom knife is mounted to the front end of the railway vehicle through a special housing member 19 which completes the framing of the snow blower housing. The profiles of rails 20 are positioned so as to indicate the coloration of the snow removal unit with respect to the rails and to the cross sectional contour of the vehicle itself. It will be seen that even with the smallest width A, at which the clearing screws are employed, the clearing screws clear a path at least equal to the vehicle. By selectively swinging one or both of the screws, a clearing path can be made greater than the width of the railway vehicle itself.

Movement of each of the deflector plates and the clearing screws are effected independently. This may be accomplished by the use of any one of a variety of known motor and linkage connections. Preferably hydraulic motors are employed, as they provide a very powerful snow removal. Preferably, the hydraulic motors are in the form of a stepping or indexing motors enabling the deflector plate or screw to be swung easily into the different positions shown in FIG. 2. On the other hand, suitable controls for the operation of the hydraulic motor, or the use of stop members such as detents, fixed linkages, etc. can be employed also to position the plates and screws during their movement.

Figure 3:
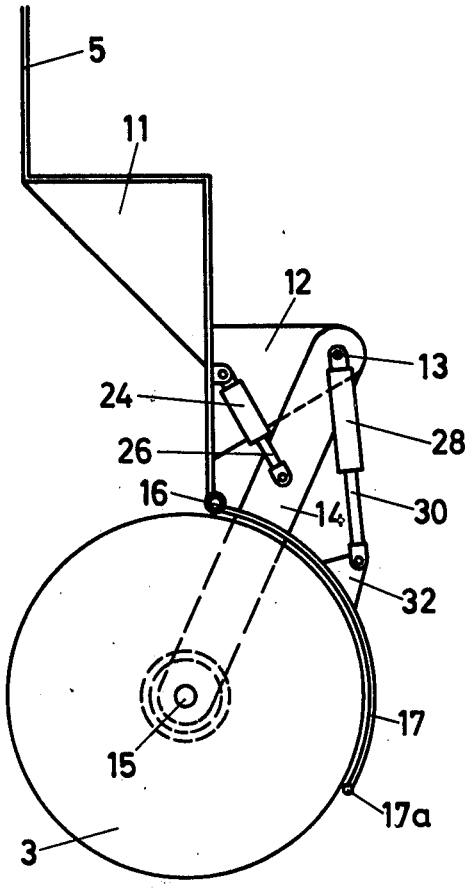
FIG. 3 is an enlarged detailed view of a portion of FIG. 2 showing the hydraulic means for swinging the vertical clearing screws and the deflector.

A representative but not limiting illustration of an example of the means for swinging the plates and the screws is shown in FIG. 3 which is an enlarged portion of the right hand side of FIG. 2. Cylinder 24 of the double acting hydraulic motor is found on the bracket 12 while its piston 26 is pivotally connected to the arm 14. The deflector 17 may similarly be activated by a hydraulic motor cylinder 28 attached to the pivoting point 13 of arm 14 and having its piston 30 attached to eye 32 of deflector plate 17. Control of the hydraulic motors can be made through conduits, extending through its control system, contained in the cab of the railway vehicle. Each of the screws and deflectors may be actuated by a single motor respectively, or a pair of motors may be used, one placed at the bottom of the housing, and the other at the upper end of the housing.

Mounted within the upper end each of the clearing screws 2, 3 is a planatary gear 21 which meshes with the drive shaft of a hydraulic motor 22 arranged above it. The pivot arm 14 is arranged between the planatary gear structure 21 and the hydraulic motor 22.

It will be seen from the foregoing that the deflector plate has two basic extreme positions, as well as several intermediate positions. In the front position either with the screws spaced narrow or wide width, the deflector is contiguous with the surface of the screw and thus guides the snow into the screw and thence into the fan. In the rearmost position, it is out of operative engagement with the screw as is indispensable when clearing curved sections of the right-of-way, hard packed snow and when there is ice. The intermediate positions serve to enlarge the actual clearing width of the unit as a whole and is also especially useful for soft fluffy snow. By selectively swinging screws and deflectors, either of both sides of the vehicle may be cleared.

Because the foward edge **17*a*** of the arcuate deflectors extend beyond the center of the screw, snow or ice which has been seized in the screw is prevented from being hurled to the exterior or outside of the unit.

Since the deflector is mounted on the exterior rear of the screw, swinging movement of the screw alone to the outside will also carry with it the associated deflector plate. Inward movement of the deflector may be effected by the hydraulic motor or coupled with the inward movement of the arm 14 by the use of the detent or ratchet type mechanism. In any event, the indexing of the motor and the provision of suitable stop means such as detents will enable selective fixing of either the screw or deflector plates in any desired position.

The present construction by enabling selective swinging of each of the clearing screws and deflectors, permits on the one hand an enlargement of the clearing width symmetrical to the track center while on the other hand also permitting an asymmetrical enlargement of the clearing width. This is important especially for clearing curves where it suffices to pivot only the clearing screw on the inside of the curve, or to pivot it out further relatively to the vehicle than the clearing screw on the outside of the curve. Intrusion of portions of the railway car into the snowbank, on the inside of the curve is thereby reliably avoided. In curved sections, with the specially narrow passageways, tunnels or other obstacles, the clearing screws can be pivoted inwardly far enough so that their outer contour corresponds to the normal track profile. As for example a standard width of 3.20 m. To achieve these functional effects, it is sufficient in general to limit the pivoting out movement of the clearing screws to a total width of about 3.50 m. An additional enlargement of approximately 10% can be easily obtained by placing the deflector plates in their intermediate position.

To prevent snow from being transported upwardly by the helical clearing screws, the deflector plates are made with inwardly extending extensions, which fit over the upper end of the clearing screw.

While the foregoing has described the preferred embodiment of the invention, various modifications and changes have also been suggested. Other modifications and changes will be obvious to those skilled in the art and therefore, it is intended that the present disclosure not be taken as limiting of the scope of the present invention.

What is claimed is:

1. Apparatus for the removal of snow from railway right-of-way comprising a housing adapted to be attached to a rail vehicle, a blower mounted within said housing, a pair of vertically rotating clearing screws attached to said housing forwardly of and flanking said blower, and an arcuate deflector plate associated with each clearing screw and pivotally mounted on said housing to the rear of each of said clearing screws to swing about a vertical axis toward and away from the associated screw, said clearing screws being pivotally mounted to swing about a vertical axis independently of each other.

2. The apparatus according to claim 1, wherein said deflector plates are pivotable in conjunction with the associated clearing screw.

3. The apparatus according to claim 1, wherein said clearing screws are supported between a pair of upper and lower pivot arms, each pivotably journalled to said housing.

4. The apparatus according to claim 3, wherein the movement of the deflector plate is coupled with the movement of the pivot arms supporting the associated clearing screw.

5. The apparatus according to claim 1, including hydraulic motor means for pivoting each of said deflector plates.

6. The apparatus according to claim 1, including means for selectively moving said deflector plates between a front position in which they embrace the clearing screw, and a rear position in which they are lifted entirely off said clearing screw.

7. The apparatus according to claim 1, wherein the deflector plates extend arcuately conforming to the generatrix of the associated clearing screw having a front edge extending forwardly of the clearing screw of between 10–30 degrees of angle.

8. The apparatus according to claim 1, wherein said deflector plates have an inwardly extending portion at its upper extending over the associated clearing screw.

9. The apparatus according to claim 1, including means for selectively swinging said clearing screws between a first operative position lying within the cross sectional area of the vehicle to which it is attached, and a second position lying in part outside the cross sectional area of the vehicle.

10. The apparatus according to claim 9, including hydraulic motor means for swinging said screws.

11. The apparatus according to claim 1, including stop means for selectively limiting the movement of said clearing screws and said deflector plates in predetermined positions.

* * * * *

UNITED STATES PATENT AND TRADEMARK OFFICE

CERTIFICATE OF CORRECTION

PATENT NO. : 4,151,663

DATED : May 1, 1979

INVENTOR(S) : Alfred Schmidt

It is certified that error appears in the above-identified patent and that said Letters Patent are hereby corrected as shown below:

In Claim 8, line 3, after "upper" insert --ends--

Signed and Sealed this

*Twelfth* Day of *February 1980*

[SEAL]

*Attest:*

SIDNEY A. DIAMOND

*Attesting Officer*

*Commissioner of Patents and Trademarks*